United States Patent [19]

Hodges

[11] 4,203,413

[45] May 20, 1980

[54] TENNIS BALL FEEDER AND RANDOM SERVER

[76] Inventor: Kenneth M. Hodges, 3750 Grandview Blvd., Los Angeles, Calif. 90066

[21] Appl. No.: 799,283

[22] Filed: May 23, 1977

Related U.S. Application Data

[63] Continuation-in-part of Ser. No. 664,376, Mar. 5, 1976, Pat. No. 4,025,071.

[51] Int. Cl.[2] ..... F41B 3/04

[52] U.S. Cl. ..... 124/78; 273/29 A; 124/49

[58] Field of Search ..... 273/29 A, 30, 26 R, 273/26 D, 176 E, 176 G, 176 H, 129; 124/45, 46, 47, 51 R, 78, 82, 10, 80, 4, 9, 1, 49, 48, 50, 41 R, 6

[56] References Cited

U.S. PATENT DOCUMENTS

| | | | |
|---|---|---|---|
| 2,705,945 | 4/1955 | Cavalier | 124/6 |
| 3,604,409 | 9/1971 | Doeg | 273/26 D |
| 3,766,901 | 10/1973 | Cleary et al. | 273/29 A |
| 3,785,358 | 1/1974 | D'Angelo et al. | 124/48 X |
| 3,807,379 | 4/1974 | Vodinh | 273/26 D |
| 4,002,336 | 1/1977 | Beaver | 273/30 |
| 4,094,294 | 6/1978 | Speer | 124/51 R |

FOREIGN PATENT DOCUMENTS

| | | | |
|---|---|---|---|
| 2438339 | 2/1976 | Fed. Rep. of Germany | 273/29 A |
| 502636 | 5/1976 | U.S.S.R. | 124/6 |

*Primary Examiner*—Richard C. Pinkham
*Assistant Examiner*—T. Brown
*Attorney, Agent, or Firm*—William H. Maxwell

[57] ABSTRACT

A tennis ball server supplied by a motorized ball feeder comprised of a trough and rotating plate that feeds balls at one rate, and wherein the server is motorized to oscillate so as to vary elevation of trajectory at another rate and is also motorized to oscillate so as to vary the traverse at still another rate; the three dissimilar motorized rates providing unpredictably placed serves, with speed control over said serves.

14 Claims, 10 Drawing Figures

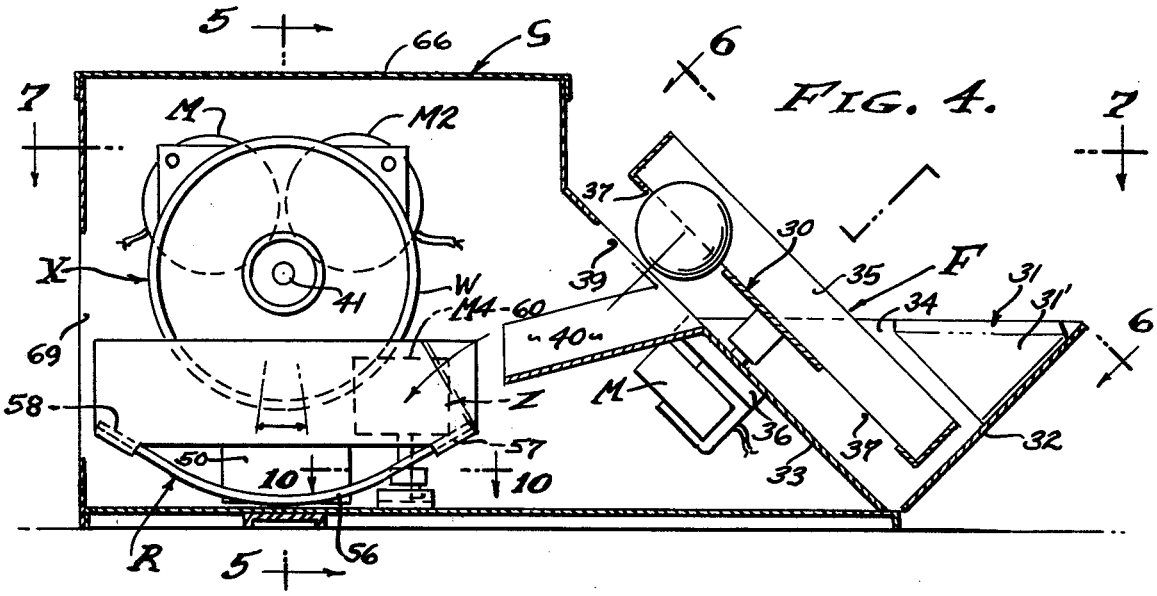
FIG. 4.
FIG. 5.
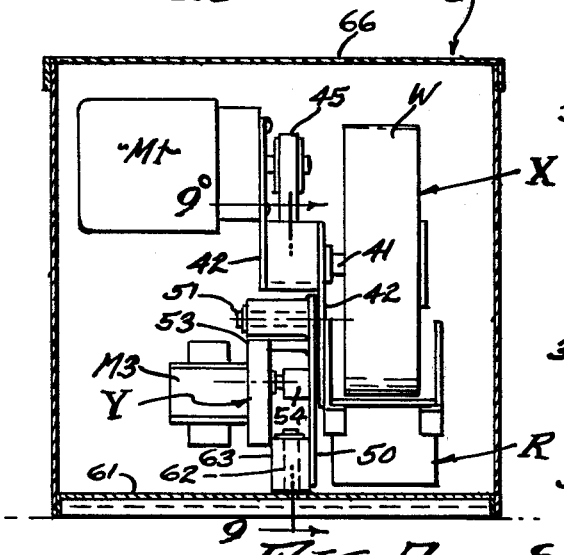
FIG. 6.
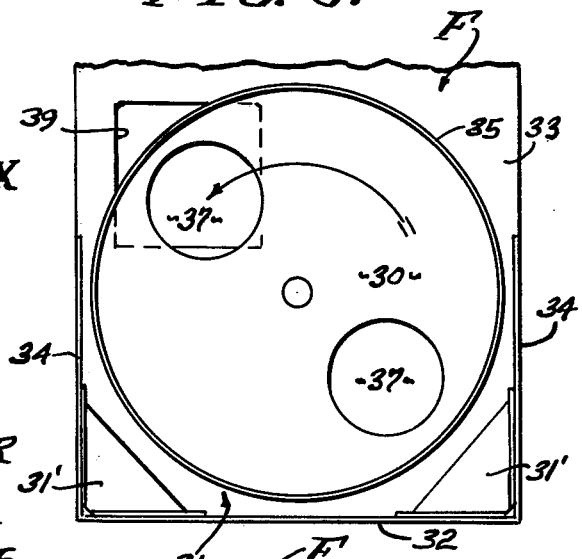
FIG. 7.
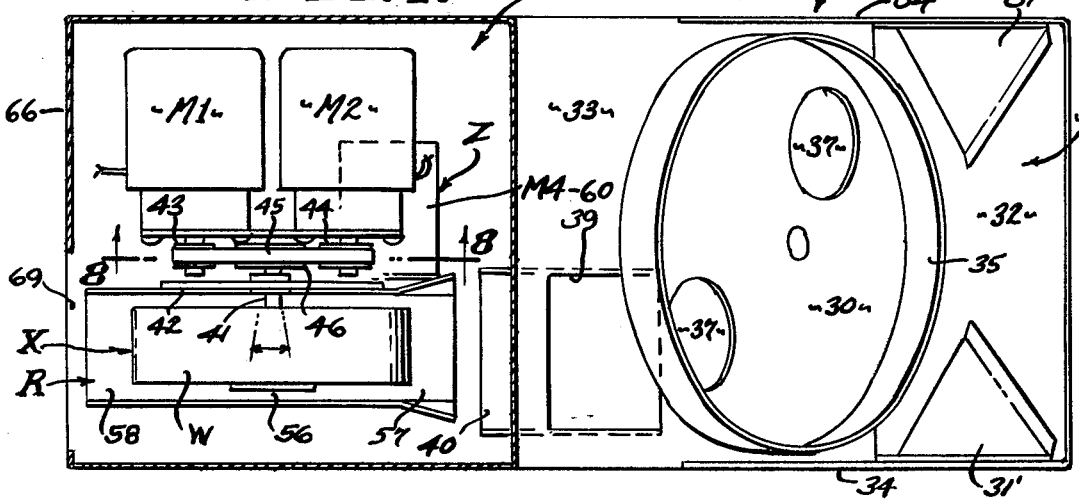

TENNIS BALL FEEDER AND RANDOM SERVER

This application is a continuation-in-part of my copending application Ser. No. 664,376 filed Mar. 5, 1976, entitled TENNIS BALL SERVER AND COURT INSTALLATION, issued May 24, 1977 as U.S. Pat. No. 4,025,071.

BACKGROUND

Tennis alleys or lanes are operated for player practice and the improvement of their game, with the objective of realistic ball delivery and efficient recovery of balls returned by the player. Prior art machines and installations for this purpose have been complex and cumbersome, they have required the storage of a large supply of balls, the acceleration means have been detrimental to ball life, and the automatic simulation of serve variations has not been altogether realistic. Therefore, it is a general object of this invention to realistically serve a small supply of tennis balls, delivering all worn balls substantially the same as new live balls, delivering said balls through a true ground stroke trajectory, and recycling all balls returned to the net.

The cost of operating full tennis courts is more than double that of half-courts; due to the added labor in retrieving balls and investment inventory in a large number of balls. Therefore, it is the half-court with which this invention is particularly concerned, or practice alleys where the player has an opportunity to develop good strokes, good footwork, and good habits by which he can correct and improve his game; or to warm-up before actual play, or simply to develop natural playing ability. To these ends it is an object of this invention to provide a tennis ball server and pick-up system that recycles a small supply of tennis balls, all without alteration to the tennis court or alley floor. With the present invention, there are no pits to dig and/or no downslope required, and elevated structures are avoided; a characteristic feature of the present invention being to serve the ball from beneath the net with moderate overspin and at a speed establishing a trajectory that permits the player to track the ball during the half-court journey; recognizing that the player reaction time is half that for a full court. In this manner the ball stays within the base line of the court to rebound in the manner of a natural serve.

The server operates to deliver tennis balls at both moderate and high velocities, involving an emitter having an inertia wheel to engage and accelerate the balls. Heretofore, elaborate motor controls have been resorted to for driving the inertia wheel at varying rates of speed, but with high costs and maintenance problems. It is an object therefore, to improve the cost and maintenance situation by converting to direct drive from separate prime movers through high and low speed gearing or belting. With the present invention, two identical electrical motors are employed, one with a larger drive pully than the other so as to drive the single inertia wheel at two speeds through one belt, as will be described.

Balls that are returned by the player and which properly pass over the net are stopped in the normal manner by a damping net in the form of a back drop that depends below the top of the playing net and over the transverse ball runs. In this way, all tennis balls that pass over the net or up and over the berm ramp become retrieved balls, and in practice the percentage of these balls is high with respect to the ability of the player. It is an object, therefore, to provide a reliable feeder for charging the server with tennis balls in timed sequence, for example one ball serve every three or four seconds. Heretofore, difficulty has been experienced with ball jambs in the ball runs from back drops, as a result of stoppage at the feeder to the server. In practice, all tennis balls are not of the same diameter and texture, and accordingly the present invention provides an improvement in this respect. With the present invention, a rimmed plate receives tennis balls in bulk in a trough, said plate operating on an inclined plane to form one side of said trough, and having at least one opening therein to form a pocket that selectively engages a single ball and carries it upon an underlying wall having a feed opening that drops said balls one at a time into the emitter of the server. As will be described, the rimmed plate feeder has a self-clearing action to prevent jambs.

The sequence of serve and the placement of rebound at the base line is unique with the present invention. Heretofore, programming for such purposes has been stereotyped and/or inflexible with respect to timing, trajectory, and direction. With the present invention these factors of time, trajectory, and direction are dissimilar so as to produce an unpredictable sequence of serve, not following a determinable pattern but rather a random sequence of indeterminable character. As will be described, the three factors are motor controlled and each functioning on a time base disassociated with the frequencies of the others. Consequently, there is no detectable serve pattern, since the phase proximity of the three dissimilar frequencies is unpredictable as a practical matter.

SUMMARY OF INVENTION

This invention relates to tennis training and especially to courts (full courts and half courts) and to alleys or lanes automated to serve and to retrieve tennis balls that are properly intercepted and returned by the player. A feature of this invention is the emission of balls at variable velocity from below the playing net with random variations in elevation and traverse. Efficient ball retrieval is an objective, accomplished by a low berm disposed beneath the net and over which the return balls pass either over or below the net, including net balls that will normally drop behind the berm. The berm provides a ramp that ascends toward the net to an elevation coincidental with the outward reaches of opposite ball runs that descend from the sides of the court or lane to the center thereof, transversely and/or beneath the playing net. A feature of the invention is the ball feeder means and server means installed within the confines of the berm to recycle tennis balls that gravitate to the feeder to be dispensed into the server at a uniform rate. The server operates to spot the ball serves at random, as a function of dissimilar phase operation of elevation and traverse means and both of which operate out of phase with respect to the feeder means. The operative means are modified as by electrical motors, the feeder means and emitter of the server means being operable at variable speeds.

DRAWINGS

The various objects and features of this invention will be fully understood from the following detailed description of the typical preferred form and application thereof, throughout which description reference is made to the accompanying drawings, in which:

FIG. 4 is a longitudinal sectional view of the feeder and server disposed as shown in FIG. 1.

FIG. 5 is a transverse sectional view taken as indicated by line 5—5 on FIG. 4.

FIG. 6 is an auxiliary end view taken as indicated by line 6—6 on FIG. 4.

FIG. 7 is a plan view, partially in section, taken as indicated by line 7—7 on FIG. 4.

Figure 1:
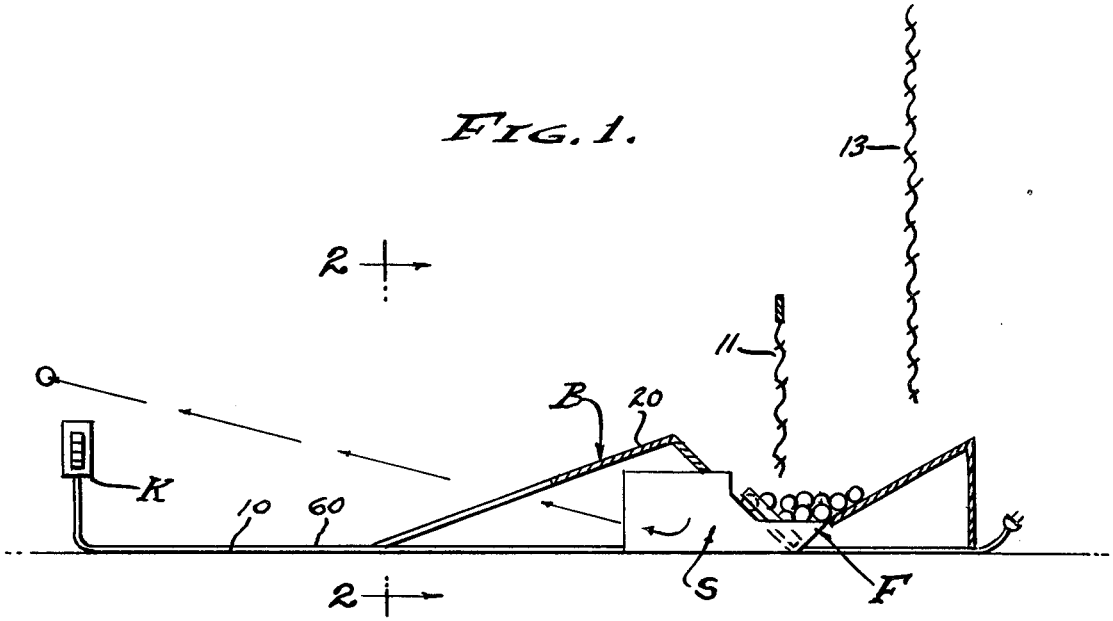
FIG. 1 is a longitudinal sectional view taken through the ball server and court installation therefor.
Figure 2:
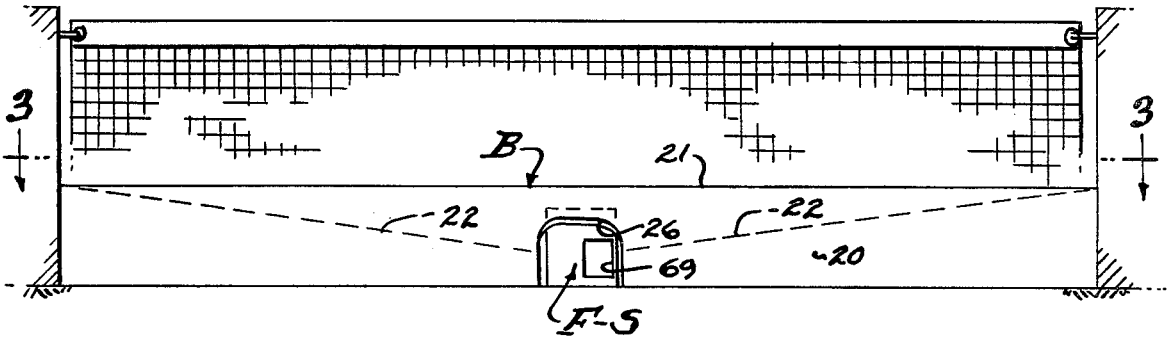
FIG. 2 is a transverse sectional view of the court installation and server taken as indicated by line 2—2 on FIG. 1.
Figure 3:
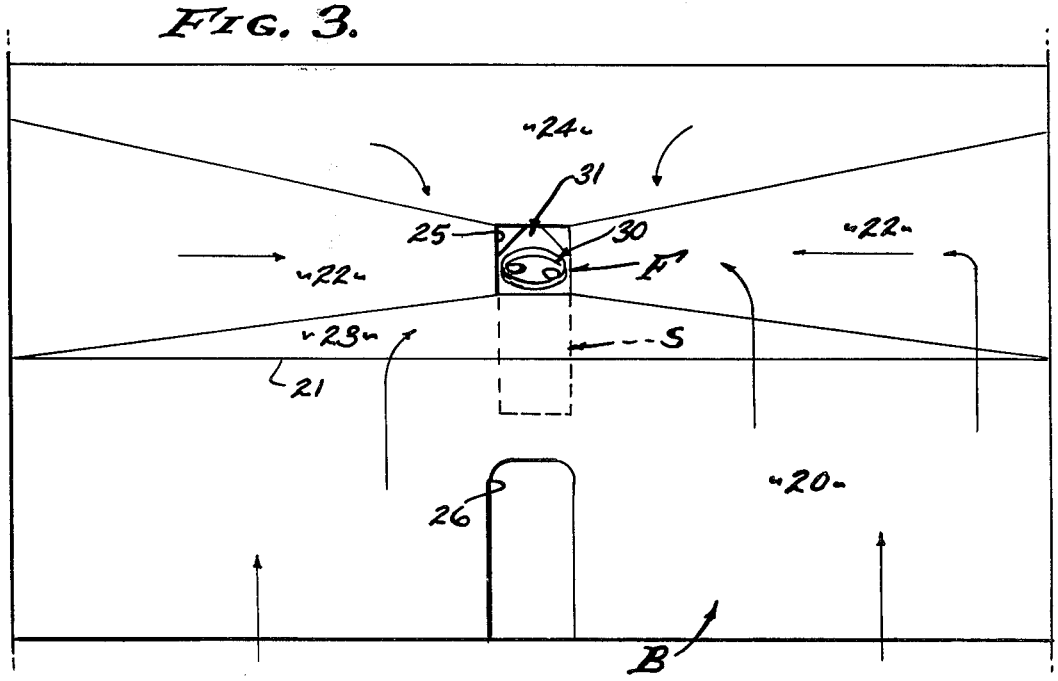
FIG. 3 is a plan view taken as indicated by line 3—3 on FIG. 2.
Figure 8:
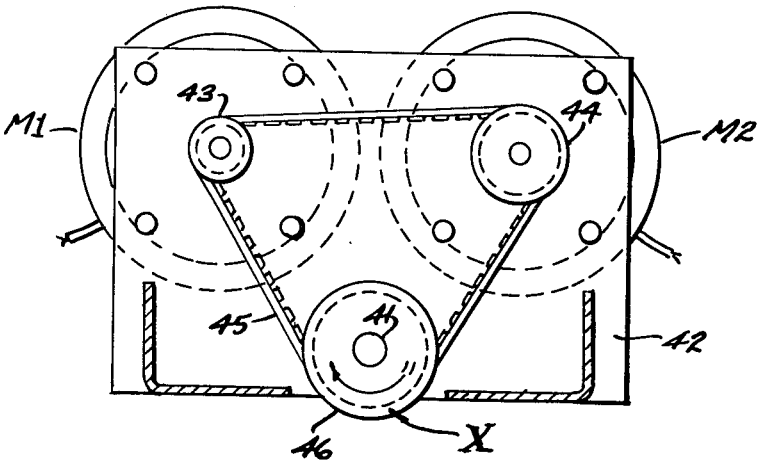
FIG. 8 is a detailed view of the inertia wheel drive taken as indicated by line 8—8 on FIG. 7.
Figure 9:
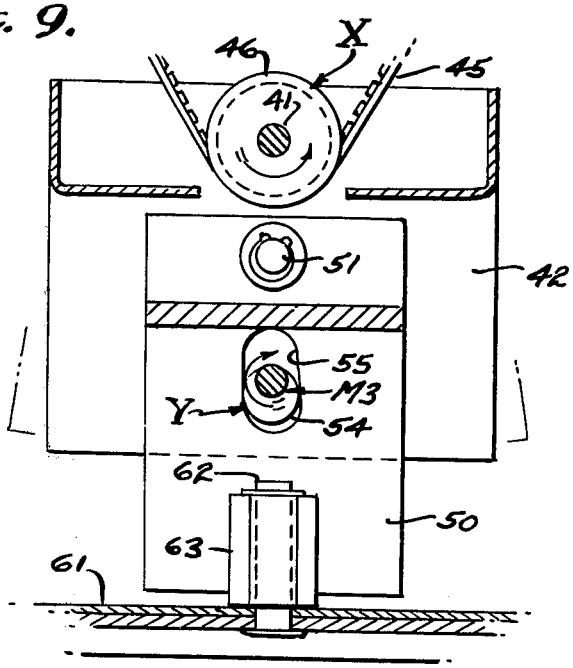
Figure 10:
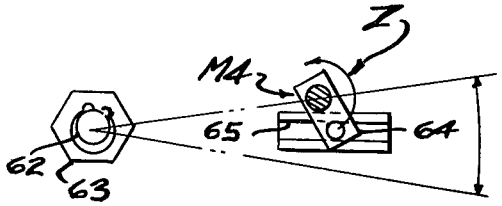

FIGS. 9 and 10 are detailed fragmentary views taken substantially as indicated by lines 9—9 and 10—10 on FIGS. 5 and 4 respectively.

PREFERRED EMBODIMENT

Referring now to the drawings, the tennis court can be a full or half court, and preferably the latter which advantageously employs "under the net" emission of balls. Therefore, this ball server and retrieval installation is shown and described herein as related to a half court, alley or lane, wherein the floor or deck surface is not altered in any way, the server being incorporated in a berm that is disposed beneath the net to retrieve all balls returned to the net, whether they pass over or beneath or into the net. Accordingly, this invention involves, generally, a berm B with transverse ball runs descending to the center of the court or lane and a feeder means F and server S supplied by the feeder means and housed within the berm, the server being comprised of a ball emitter X, elevation means Y, and traverse means Z. The means E, X, Y and Z are motivated as by electrical motors energized individually or simultaneously to automatically serve and retrieve the tennis balls returned by the player.

The tennis court or lane is a flat horizontal rectangular surface 10 with a net 11 stretched transversely thereof mid-way of a full court or at one end of a half court or lane. The top of the net is usually thirty-eight inches above the surface 10 and depends within fourteen to fifteen inches thereof, having a top margin that is taught with a depending mesh that is loose and adapted to damp the travel of low balls striking thereagainst. Behind the net 11 and extending to a substantial height is a damping net 13 that presents a loose mesh to damp the travel of high balls striking thereagainst. The base line (not shown) behind which the balls are spotted for rebound is a transverse line fifteen feet from the net and parallel thereto. The court or lane may or may not have a center line (not shown).

Referring now to the server installation, the berm B extends coextensively with the net 11 and comprises a planar ramp 20 that ascends from the court surface 10 to an elevation approximating the lower margin of the net, and terminating in a ridge 21 spaced forward from and parallel to the net. In practice, the ascension angle of the ramp is about twenty degrees. Behind the ramp 20 and descending from the ridge 21 there is a front drop panel 23 that is planar and extends from said ridge to the ball runs 22 next to be described; and descending from behind the aforementioned damping net 13 there is a back drop panel 24 that is planar and also extends to the said ball runs. In practice, the descension angle of the front and back drop panels 23 and 24 is about thirty degrees. The ramp and drop members 20, 23 and 24 are parallel transverse members and each coextensive with the width of the court or lane and the net 11.

The ball runs 22 descend from a maximum elevation at the side extremities of the court, or lane and of the berm B, and extend to the center of the net 11 and an opening 25 adapted to drop one or more balls by gravity therethrough. The descent angle of the ball runs 22 is about one to five (as shown) and the centered opening 25 is about five inches above the surface 10. It will be apparent that balls returned by the player will be damped by net 11 or 13, or will pass over the ridge 21 to drop onto the ball runs 22 in order to gravitate to the opening 25.

The feeder means F and server S are cooperatively installed within the confines of the berm B beneath the opening 25, there being an emitter window 26 in the forwardly facing ramp 20 for the emission of balls served immediate to the court surface 10. In practice, the feeder means F and server S are cooperatively mated units, the former a low profile device disposed on a transport axis normal to the transverse berm B, and the latter a higher profile device, and both of which are housed within the confines of the said berm. In accordance with this invention, the feeder means F is a motorized feed means and the server S is a motorized emission means, each dependent upon the other and operating at a dissimilar rate (phase) relative to each other. The units F and S are contained within a housing underlying the opening 25 and disposed behind the window 26.

The feeder means F comprises a plate 30 revolving on an inclined axis to form the front feed side wall of a trough 31 that occupies the opening 25 and into which the tennis balls drop as they roll inwardly from the opposite ball ramps 22 and drop panels 23 and 24. As shown, the trough 31 is comprised of upwardly divergent back and front walls 32 and 33, and side walls 34 spaced to clear the outside diameter of the plate, the walls 32 and 34 terminating in a horizontal plane at the major diameter (11 inches) of the plate 30, and the front wall 33 extending upwardly to coextensively underlie said plate 30. The plate 30 is a disc that overlies the front wall 33, with a rim 35 projecting away from the wall 33 a distance approximating half the diameter of the tennis balls, (nominally 2.6 inch diameter), and likewise the plate 30 is spaced from the front wall 33 a distance approximately half the diameter of the tennis balls.

In accordance with this invention a motor M and gear drive 36 operates the plate 30 to revolve at the rate of 7 RPM, there being a ball opening 37 through the circumferential margin of the plate to freely pass a tennis ball adjacent the rim 35, preferably diametrically opposite openings 37 so as to receive one ball while dropping another. The tennis balls drop into the trough 31 by gravity, there being corner baffles 31' converging from the back wall 32 to the opposite lower peripheral portions of the plate rim 35, thereby exposing the openings 37 within the trough throughout 180° of travel so that the balls inherently drop into said openings 37 as the plate and rim revolve.

The gear drive shaft 36 of the motor M rotates the plate 30 in a counterclockwise direction, when viewing the same forwardly as shown in FIG. 6, in which case a feed opening 39 through wall 33 is placed beyond the top-dead-center position thereof, centered 45° beyond the vertical. Accordingly, the descending ball carried in the plate opening 37 is urged downward by the plate so as to drop into the feed opening 39, having pushed other balls out of its path during upward turning of the plate. Characteristically therefore, the feed opening is at one side of the housing, to the left side when viewed forwardly, and from which a feed chute 40 extends forwardly within the housing terminating in proximity to the open rail of the emitter X of the server S, later described.

The server S is comprised of the ball emitter X articulately motivated to automatically vary the elevation and traverse by the means Y and Z respectively. To this end, the elevation means Y and Z are cooperatively combined to form a turret that movably mounts the ball emitter X, the latter comprising an inertia wheel W and a rail R opposed to the periphery of said wheel to receive and drive balls engaged therebetween. The inertia wheel W is selectively driven by either of two motors M1 or M2, on a drive shaft 41 disposed on a transverse horizontal axis. The wheel W is metallic or the like with a hard right cylinder surface having an outside diameter of approximately 7½ inches and revolved at moderate or high speed by said motors respectively. In accordance with this invention, identical motors M1 and M2 are employed, motors that operate at a shaft speed of 3200 RPM, and positioned side by side on spaced parallel transverse axes offset above and parallel to the aforesaid pully shaft 41 axis. As shown and preferred, the power transmission between the motors M1 and M2 and the drive shaft 41 is a belt drive comprising a moderate speed pully 43 on the shaft of motor M1, and a high speed pully 44 on the shaft of motor M2. In practice, a cogged-belt 45 and pully transmission is employed with a large diameter drive pully 46 on shaft 41, having a ratio of two to one with respect to pully 43, and having a ratio of one and one half to one with respect to pully 44. Accordingly operation of motor M1 rotates inertia wheel W at 1600 RPM while operation of motor M2 operates said wheel at 2400 RPM. In practice, the motors M1 or M2 are totally deenergized when not in use, so as not to generate electromotive force. As shown, the motor and wheel assembly is carried upon a joggled vertically disposed oscillating plate 42 disposed in a fore and aft plane normal to the rotational axis of said motor and wheel, the plate 42 being positionably mounted upon a stand 50 on an axis below and parallel to the wheel axis by a horizontal pivot 51 and motorized to vary the elevation of serve.

Referring now to the elevation means Y, the rail R is carried by the plate 42 so as to clear the lowermost space limit of the server housing, said rail comprising a drive section 56 concentric with the wheel W throughout an arc of approximately fourty-five degrees, and with exit and entry portions 57 and 58 extended tangentially therefrom approximately three inches, respectively. Section 56 is spaced approximately two inches radially from the periphery of wheel W so as to compress conventional tennis balls which are normally 2.6 inches in diameter. As shown, the stand 50 is vertically disposed adjacently behind (with respect to wheel W) the plate 42 and mounts a gear-head motor M3 and gear drive 53 with an eccentric crank 54 (see FIG. 9) engaged in a vertically disposed drive slot 55 in plate 42 below the pivot 51. In practice, the plate is oscillated through an arc of approximately ten degrees by revolvement of said crank 54, and correspondingly varies the elevation of the emitter X. In accordance with the invention, this oscillation is at the rate of 4 RPM from the gear drive 53 which is out of phase with the aforesaid feed cycle of fourteen balls per minute, and to the end that an out of phase relationship exists therebetween.

Referring now to the traverse means z, the stand 50 is positionably mounted to a base 61 by a vertical pivot 62 and motorized by a motor M4 to vary the traverse position of the machine. As shown, the stand 50 is affixed to a boss 63 and over the pivot closely adjacent to the stand and plate 42 and preferably in the vertical plane. The motor M4 and its gear drive 60 revolves an eccentric crank 64 (see FIG. 10) engaged in a slot 65 on the platform and disposed radially to said pivot 62, so as to oscillate the platform and stand through an arc of ten degrees, and thereby vary the traverse position of the emitter X. In accordance with the invention, this oscillation is at the rate of 6 RPM from the gear drive 60, or six cycles, which is out of phase with each of the aforesaid feed and elevation cycles of seven and four cycles per minute, respectively, and all to the end that an out of phase relationship exists therebetween.

The server S with its emitter X, elevation means Y and traverse means Z is accommodated within a housing 66 having the ball feed opening or port 39 and an emitter port 69. Thus, the operative mechanisms are protectively enclosed. In carrying out the invention, there is a speed control K for the motors M1 and M2 so as to select the velocity of the serve, and this control K can be located at the housing or remoted by cable 60 as indicated. It is thereby understood that motors M, M1, M2, M3 and/or M4 can be individually or jointly operated by means of switches at the control K to vary the server operation.

From the foregoing it will be seen that a relatively few number of balls is required to supply this tennis ball server and court installation, depending of course upon the return capability of the player. In this respect, every ball that goes over the net, or strikes the net, or passes up and over the berm is recycled by the feeder. A feature of this invention is the simplicity of the feed mechanism that involves the rimmed plate 30 that is complementary to the trough 31 and operable to ensure continuity of operation. As the plate 30 revolves there is a shuffling of tennis balls within the trough 31 and the initial drop of a single ball into one opening 37 therefor. Continued revolvement of the plate 30 lifts the said ball over a top-dead-center position for downward movement through the inclined feed opening 39 in the front wall 33 of the trough. Subsequently, the balls are then individually delivered by the chute 40 to be engaged by the wheel W when dropped onto the declined entry portion 57 of the rail R, to be driven forwardly and emitted on a trajectory determined by the means Y and Z. As stated hereinabove, the placement and/or spotting of the ball serves is repeated every 84 cycles or every 5.6 minutes, a programming that cannot be anticipated as a practical matter by the player and which in effect produces random serves. There is complete recovery of all balls hit to the net, and immediate and complete recycling of those balls. As a result, the installation functions adequately with only 12 to 17 balls, even when allowing for up to 10 balls on the court which do not reach the net.

Having described only a typical preferred form and application of my invention, I do not wish to be limited or restricted to the specific details herein set forth, but wish to reserve to myself any modifications or variations that may appear to those skilled in the art:

I claim:

1. A server for tennis balls and for varied placement of said balls to be returned by a player and including; a feeder means operated to sequentially deliver tennis balls at one rate to a ball emitter means, a shiftable turret comprised of a stand shiftable about a vertical axis and carrying a plate shiftable thereon about a horizontal axis directionally supporting the emitter means, and motorized oscillator means shifting the stand and plate of said turret at rates dissimilar to each other and to the said ball delivery rate, whereby unpredictable serve placement is attained.

2. The tennis ball server as set forth in claim 1, wherein each oscillator means comprises a motor and crank drive shifting the stand on said vertical axis for traverse placement and shifting the plate on said horizontal axis for elevation placement respectively.

3. A server for tennis balls and for varied placement of said balls to be returned by a player and including; a fixedly positioned feeder means sequentially delivering tennis balls at one rate to a ball emitter means comprised of an inertia wheel disposed on a horizontal axis overlying a rail concentric therewith to compress balls engaged upon said rail having an entry portion continuously exposed to said feeder means to receive balls and having an exit portion to emit said balls, a shiftable turret comprised of a stand shiftable about a vertical axis and carrying a plate shiftable thereon about a horizontal axis directionally supporting the emitter means, motor means carried by the plate of the turret and revolving the wheel on said horizontal axis to move said balls from said entry portion to said exit portion of said rail for accelerated emission of said balls, and motorized oscillator means shifting the stand and plate of said turret at rates dissimilar to each other and to the said ball delivery rate, whereby unpredictable serve placement is attained.

4. The tennis ball server as set forth in claim 3, wherein the said feeder means delivers balls at a first rate, wherein a first oscillator means shifts the stand at a second dissimilar rate on the vertical axis for traverse placement, and wherein a second oscillator means shifts the plate at a third dissimilar rate on the horizontal axis for elevation placement.

5. The tennis ball server as set forth in claim 3, wherein each oscillator means comprises a motor and crank drive shifting the stand on said vertical axis for traverse placement and shifting the plate on said horizontal axis for elevation placement respectively.

6. A feeder and server for tennis balls of conventional diameter and for emitting said balls to be returned by a player and including; a "V"-shaped feed trough comprised of upwardly divergent back and front walls to receive said balls, a disc-shaped feed plate of substantially lesser thickness than the ball diameter and on an inclined axis normal to and spaced from said front wall of the trough, at least one ball receiver opening through a marginal portion of the feed plate, and the feed plate having a rim projecting therefrom in a direction away from the front wall of the trough a distance substantially half the diameter of the conventional tennis ball, a feed opening through the front wall of the trough and underlying the marginal portion of the feed plate, a motor means revolving the feed plate to sequentially align the said at least one receiver opening with the said feed opening whereby a ball is dropped through the feed opening, and emitter means aligned with the said opening to serve the dropped ball.

7. The tennis ball feeder and server as set forth in claim 6, wherein the feed plate is spaced from the front wall of the trough a distance substantially half the diameter of the conventional tennis ball to engage the major diameter thereof.

8. The tennis ball feeder and server as set forth in claim 6, wherein the feed opening through the front wall of the trough is positioned beyond a top-dead-center revolvement of the receiver opening through said feed plate for gravity drop of a ball therethrough and away from other overlying balls.

9. The tennis ball feeder and server as set forth in claim 6, wherein the feed opening through the front wall of the trough is positioned substantially 15° of turn beyond a top-dead-center revolvement of the receiver opening through said feed plate for gravity drop of a ball therethrough and away from other overlying balls.

10. The tennis ball feeder and server as set forth in claim 6, wherein the feed plate is spaced from the front wall of the trough a distance substantially half the diameter of the conventional tennis ball, wherein the at least one receiver opening through the feed plate is adjacent the rim thereof, and wherein the feed opening through the front wall of the trough is positioned substantially beyond a top-dead-center revolvement of the receiver opening through said feed plate for gravity drop of a ball therethrough and away from other overlying balls.

11. A change speed tennis ball server for emitting balls to be returned by a player and including; a feeder means sequentially delivering said balls to an inertia wheel disposed to engage and accelerate said balls for emission at a velocity dependent upon the speed of rotation of said inertia wheel, and speed control means therefor comprising at least two individually energized drive motors and each having transmission means to said inertia wheel to rotate the same at a different speed respectively.

12. The change speed tennis ball server as set forth in claim 11, wherein the at least two drive motors operate at the same rotational speed with distinct transmission means to rotate the inertia wheel.

13. The change speed tennis ball server as set forth in claim 11, wherein the at least two drive motors operate at the same rotational speed with distinct belt drive transmission means therefrom and to the inertia wheel to rotate the inertia wheel.

14. The change speed tennis ball server as set forth in claim 11, wherein the at least two drive motors operate at the same rotational speed with a single transmission belt drive over drive pulleys of distinct diameter and over a driven pulley operating the inertia wheel.

* * * * *